United States Patent [19]

Vandevier

[11] Patent Number: 4,741,208

[45] Date of Patent: May 3, 1988

[54] PUMP DIFFERENTIAL PRESSURE MONITOR SYSTEM

[75] Inventor: Joseph E. Vandevier, Claremore, Okla.

[73] Assignee: Hughes Tool Company, Houston, Tex.

[21] Appl. No.: 916,915

[22] Filed: Oct. 9, 1986

[51] Int. Cl.[4] ..... E21B 47/06

[52] U.S. Cl. ..... 73/155; 166/66; 417/63

[58] Field of Search ..... 73/155, 168, 714; 417/63; 166/66

[56] References Cited

U.S. PATENT DOCUMENTS

| | | | |
|---|---|---|---|
| 3,323,360 | 6/1967 | Nutter | 166/264 |
| 4,108,243 | 8/1978 | King et al. | 166/66 |
| 4,316,386 | 2/1982 | Kerekes | 73/151 |
| 4,461,172 | 7/1984 | McKee et al. | 73/155 |
| 4,477,230 | 10/1984 | Knox et al. | 417/63 |
| 4,487,261 | 12/1984 | Gazda | 166/264 |

*Primary Examiner*—Jerry W. Myracle

*Attorney, Agent, or Firm*—James E. Bradley

[57] ABSTRACT

A pump differential pressure monitor system enables both discharge and intake pressure to be monitored at the surface of a centrifugal well pump. This system includes a tubular sub mounted between the pump and the tubing. A receptacle is located inside the sub. A bypass passage extends past the receptacle for directing fluid discharged from the pump past the receptacle and into the tubing. A pair of pressure sensors are lowered on conductor cable and located inside the receptacle. One of the sensors communicates with the bypass passage to monitor discharge pressure. A port extends from the receptacle to the exterior of the sub and communicates fluid to the other pressure sensor for monitoring intake pressure.

4 Claims, 2 Drawing Sheets

PUMP DIFFERENTIAL PRESSURE MONITOR SYSTEM

BACKGROUND OF THE INVENTION

1. Field of the Invention

This invention relates in general to monitoring downhole pressures in a well, and in particular to a system for monitoring both intake and discharge pressure of a centrifugal pump.

2. Description of the Prior Art

In a submersible pump well system, a downhole electric motor rotates a centrifugal pump. The pump is connected to tubing for pumping the well fluid drawn in from the annulus surrounding the tubing to the surface.

In some systems, the intake pressure to the pump is monitored. The intake pressure is important to determine well drawdown and the response of the reservoir at various flow rates. The intake pressure is monitored by a downhole pressure sensor. The signal from the pressure sensor is monitored at the surface either through a separate line or by superimposing the signal onto the power cables used to supply power to the motor. Temperature is also measured in some installations.

One disadvantage of the present systems is that they do not have any means for also monitoring the downhole discharge pressure of the pump. Consequently, the true differential pressure of the pumping system cannot be obtained. The true differential pressure of the pump is important for determining the pump operating point on the flow-head curve. This is valuable for pinpointing pump performance and pumping problems.

Another disadvantage with some of the present systems is that the downhole pressure sensing equipment cannot be retrieved without pulling the tubing and the pump. Pulling the tubing and the pump is an expensive operation, and is normally performed no more than about every eighteen months for purposes of repairing a failed pumping system. As a result, if the pressure sensor malfunctions, normally, the operator must wait until it is time to pull the pump before repairing or replacing the pressure sensor. Several months may pass where the well would be without any type of pressure sensor.

SUMMARY OF THE INVENTION

In this invention, a system is provided that will measure not only the intake pressure but also the discharge pressure of the pump. Also, this system can be retrieved without pulling the pump and tubing. This system includes a tubular sub which is mounted between the pump and the tubing. A receptacle is located inside the sub. A bypass passage extends past the receptacle for directing fluid discharged from the pump past the receptacle and into the tubing.

A pair of pressure sensors are lowered on a cable and seated inside the receptacle. A port connects one part of the receptacle to the annulus. Another port connects another part of the receptacle to the bypass passage which contains fluid at the discharge pressure.

The pressure sensors when seated divide the receptacle into two chambers, with one of the pressure sensors communicating with one port and the other pressure sensor communicating with the other port. The electrical cable from which the pressure sensing unit is lowered also provides power to the sensors and transmits electrical signals from the sensors to the surface.

DESCRIPTION OF THE PREFERRED EMBODIMENT

Figure 1:
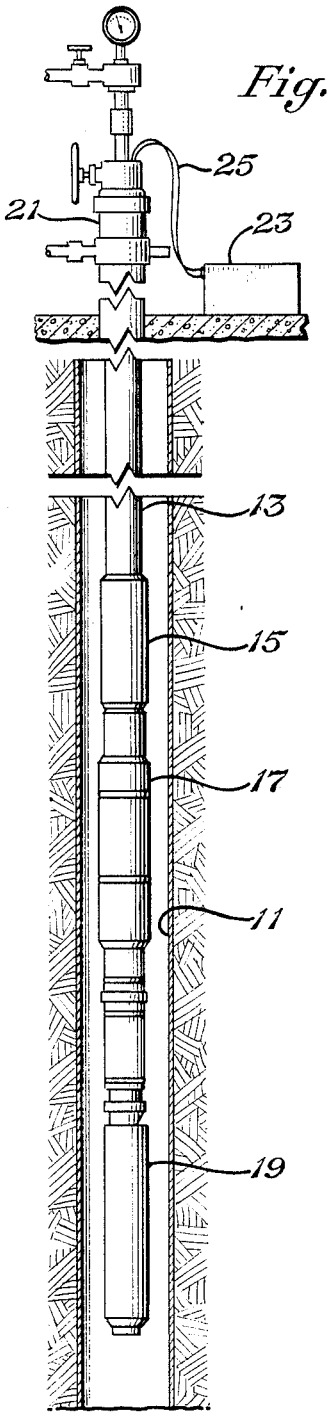
FIG. 1 is a schematic view illustrating a pump assembly located in a well.

Referring to FIG. 1, the well shown has casing 11. Casing 11 contains perforations (not shown) that cause well fluid to flow into the casing for production to the surface. A string of tubing 13 extends downwardly into the casing 11. A pressure sensor sub 15 is mounted to the lower end of the tubing 13. A centrifugal pump 17 is mounted to the pressure sensor sub 15. The centrifugal pump 17 is driven by an electrical motor 19 located on its lower end.

The centrifugal pump 17 is rotated by the electrical motor 19 to produce fluids from the annulus in casing 11 surrounding tubing 13. The production fluid flows through the tubing 13 to a Christmas tree 21 at the surface. From there, the fluid is delivered to equipment for processing, storage and transportation. A power supply 23 at the surface delivers alternating current voltage over a power cable 25 to the electrical motor 19. The power cable 25 is located on the exterior of the tubing 13.

Figure 3:
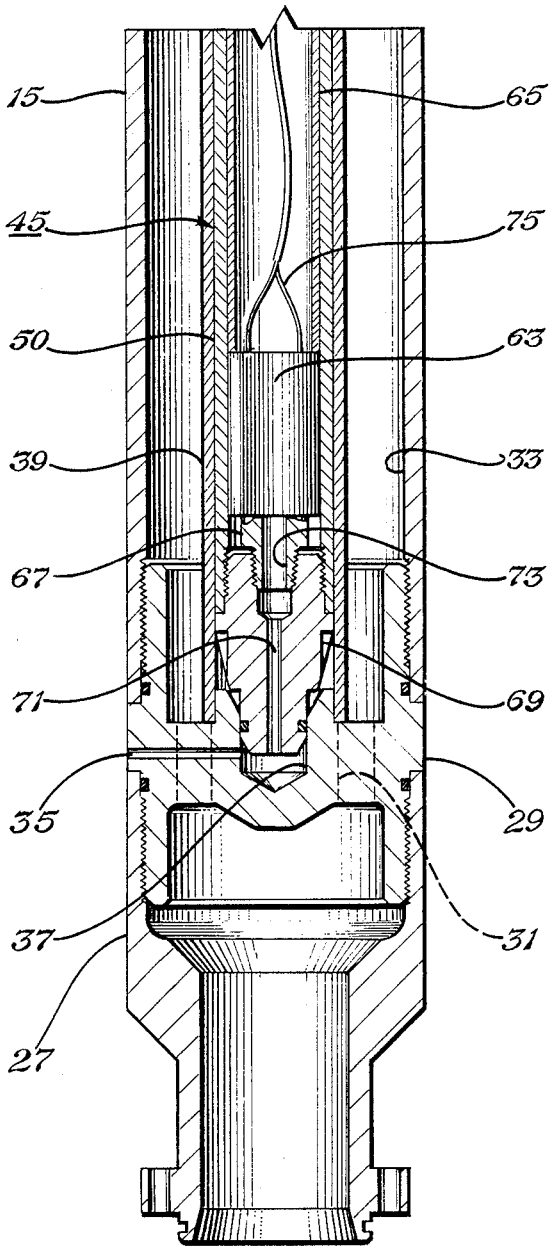
FIG. 3 is a view of the lower portion of the pressure sensing system of FIG. 2.

Referring to FIG. 3, the pressure sensor sub 15 includes a lower adapter 27 which is adapted to be mounted to the upper end of the centrifugal pump 17 (FIG. 1). A nipple 29 is located in the lower adapter 27. Nipple 29 has a plurality of vertical passages 31 that extend through for allowing fluid discharged from the pump 17 to flow into the bore 33 of the pressure sensor sub 15. An annulus port 35, comprising a small cylindrical drilled hole, extends from the exterior of the nipple 29 to a seat 37 located in the center of the nipple 29. Seat 37 is a cylindrical cavity coaxial with the pressure sensor sub 15 and the lower end of the tubing 13.

Figure 2:
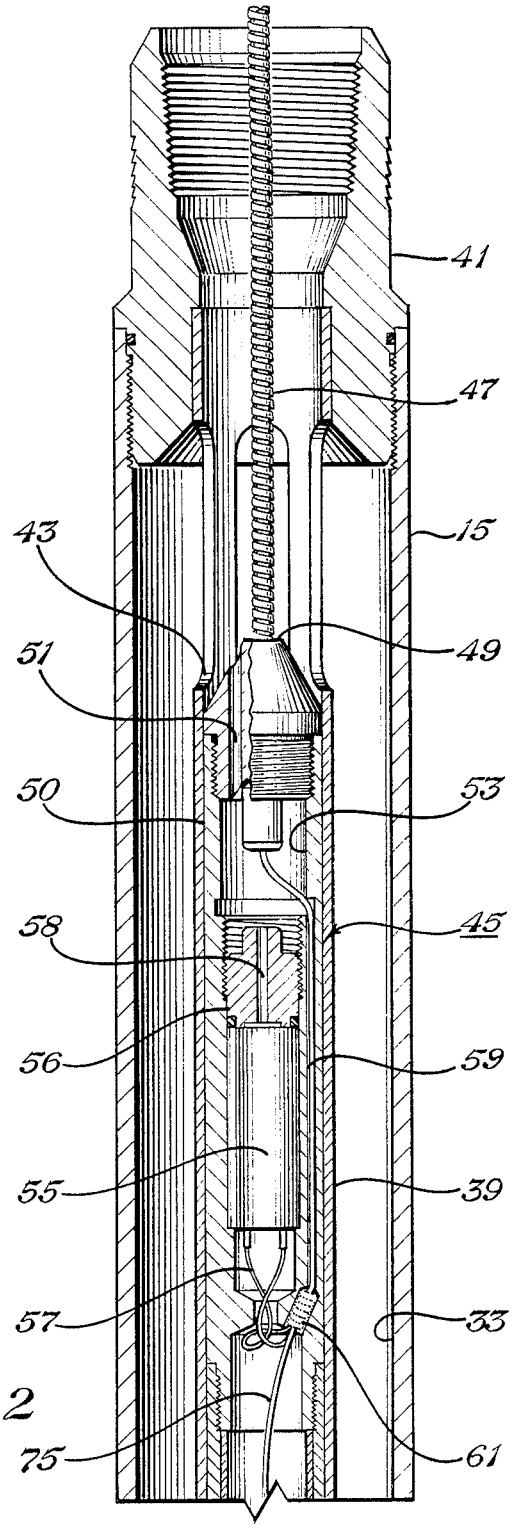
FIG. 2 is a view of the upper portion of a pressure sensing system constructed in accordance with this invention.

A receptacle tube 39 is mounted around the seat 37 and extends upwardly where it joins an upper adapter 41, shown in FIG. 2. The upper adapter 41 is adapted to be secured to the lower end of the tubingt 13 (FIG. 1). The annular space in bore 33 surrounding the receptacle tube 39 comprises a bypass passage for the fluid discharged from the pump 17 to flow upwardly through the bore 33.

A bypass port 43 is located in the upper end of the receptacle tube 39. The bypass port 43 is a plurality of large elongated apertures located directly below the upper adapter 41. The production fluid flows through the port 43, through the passage in the upper adapter 41, and into the tubing 13 (FIG. 1). The interior of the receptacle tube 39 is exposed to the discharge pressure through the bypass port 43.

A pressure sensing unit 45 is adapted to be lowered and retrieved on conducter cable 47. Cable 47 is of a type conventionally used in logging and perforating wells. It contains an outer armor and at least one insulated conductor therein. Conductor cable 47 is connected to a cable head 49 which is located at the upper end of the pressure sensing unit 45. Head 49 is screwed to the upper end of a housing 50 of the pressure sensing unit 45. A small passage 51 extends through the head 49 to allow fluid in the bypass port 43 to flow downwardly in the housing 50. When the pressure sensing unit 45 is seated in the receptacle tube 39, the head 49 will be located substantially at the lower edge of the bypass port 43.

The passage 51 through the head 49 leads to an upper chamber 53 contained within the housing 50. An upper pressure sensor 55 is sealingly located in the upper chamber 53. Upper pressure sensor 55 is secured by a retaining plug 56 which is secured by threads and sealed in the housing 50. A passage 58 extends through the retaining plug 56 to communicate fluid pressure in the upper chamber 53 with the sensing portion located on the upper end of the upper pressure sensor 55. A pair of wires 57 are located on the lower end of the upper pressure sensor 55. Wires 57 extend through a side passage 59 to the cable 47 for transmitting signals and power between the sensor 55 and the conductor in cable 47. The side passage 59 is sealed at its lower end with seal 61. Fluid in the chamber 53 cannot flow downwardly past the upper sensor 55.

Referring again to FIG. 3, a lower pressure sensor 63 is located in the housing 50 in a lower chamber. Lower sensor 63 is retained by an upper sleeve 65 on its upper end and a retainer 65 on its lower end. Retainer 67 screws into a seating plug 69 which protrudes from the lower end of the housing 50. A passage 71 in the seating plug leads to a passage 73 in the retainer 67.

Seating plug 69 is adapted to sealingly locate in the seat 37 when the pressure sensing unit 45 is lowered into the receptacle tube 39. The seals on the seating plug 69 prevent fluid from annulus passage 35 from flowing upwardly around the housing. Passages 71 and 73 communicate fluid in the seat 37 with the pressure sensing portion of the lower pressure sensor 63. The lower sensor 63 is sealed in housing 50 so that fluid cannot flow upwardly in housing 50 past the lower sensor 63. A pair of wires 75 on the upper end of the lower pressure sensor 63 are connected through the side passage 59 (FIG. 2) to the conductor of cable 47.

The cable 47 leads through the tubing 13 to a surface panel (not shown) located on the surface. The surface panel and the two pressure sensors 55 and 63 are of conventional types. They may be constructed as shown in U.S. Pat. No. 4,477,230, Knox, et al, Oct. 16, 1984, or in U.S. Pat. No. 4,581,613, Ward et al., Apr. 8, 1986, or by other means. The temperature sensor shown in these patents could be replaced by the second pressure sensor. Some downhole circuitry will be required, which can be located at a convenient point in the pressure sensing unit 45.

In operation, the pressure sensor sub 15 will be mounted to the centrifugal pump 17, then lowered into the well on tubing 13. After the pump 17 is located at the proper depth, the pressure sensing unit 45 is secured to cable 47 and lowered through the tubing 13 by using a winch (not shown) located at the surface. The pressure sensing unit 45 will slide into the receptacle tube 39. The seating plug 69 will seat in the seat 37. The cable 47 is removed from the winch and connected to a surface panel (not shown) which will provide power to the sensors 55 and 63, and monitor and record the pressures sensed.

Once the pump is in operation, the pressure at the annulus port 35 (FIG. 3) will be substantially intake pressure, because it is located only the length of the pump 17 from the intake which is at the lower end. Similarly, the pressure at the bypass port 43 is substantially the discharge pressure of the pump 17, because it is located only a few feet away from the top of the pump 17. Electrical power will be supplied through the conductor cable 47 to the pressure sensors 55 and 63. The sensors 65 and 63 will monitor the pressures at the intake and discharge, providing a differential pressure. The date will be transmitted alternately to the surface panel for monitoring and recording. Typical differential pressures sensed will be from 1000 to 4000 pounds per square inch.

Should the pressure sensing unit 45 malfunction, it can be retrieved by using a wireline logging winch. The upper end of the cable 47 will be wrapped around an empty winch, then pulled upwardly to pull the pressure sensing unit 45 to the surface. If it is desired to operate the pump 17 while the pressure sensing unit 45 is out of the well, a plug (not shown) can be lowered into the receptacle tube 39.

The invention has significant advantages. The pressure sensing unit enables discharge and intake pressure to be monitored at the surface for a centrifugal pump. This allows one to pinpoint the proper operating point for the pump. If equipped with a variable speed dirve system, the pump's speed can be varied to maintain the desired operating point. Also, the pressure sensing unit can be retrieved while the pump remains in the hole. This allows one to quickly repair or replace a pressure sensing unit. The operator does not have to wait until it is time to pull the pump and tubing for maintenance.

While the invention has been shown in only one of its forms, it should be apparent to those skilled in the art that it is not so limited, but is susceptible to various changes without departing from the scope of the invention.

I claim:

1. In a well having casing and a submersible pump connected to a string of tubing for drawing production fluid from the annulus between the casing and the tubing and pumping the fluid through the tubing to the surface, the improvement being means for monitoring at the surface the pressure in the annulus and in the tubing adjacent to the pump comprising:

a sub mounted between the pump and the tubing;

a receptacle located inside the sub;

bypass passage means extending past the receptacle for directing fluid discharged from the pump past the receptacle and into the tubing;

a pair of pressure sensors located inside the receptacle, one of the sensors being in communication with the bypass passage means for monitoring pressure in the tubing;

port means extending from the receptacle to the exterior of the sub for communicating annulus pressure to the other sensor; and electrical cable means extending from each of the pressure sensors to the surface for transmitting electrical data from the pressure sensors to the surface.

2. In a well having casing and a submersible pump connected to a string of tubing for drawing production fluid from the annulus between the casing and the tubing and pumping the fluid through the tubing to the surface, the improvement being means for monitoring at the surface the pressure in the annulus and in the tubing adjacent to the pump comprising:

a tubular sub mounted between the pump and the tubing;

a tubular receptacle mounted inside the sub, having an inner cavity, the upper end of which registers with the interior of the tubing;

a bypass port located in the receptacle and in communication with the cavity;

bypass passage means extending through the sub for directing fluid discharged by the pump around the receptacle and through the bypass port to the tubing;

an annulus port located below the bypass port and extending from the cavity to the exterior of the sub in communication with fluid in the annulus;

an upper and a lower pressure sensor joined together in a pressure sensing unit;

cable means for lowering the pressure sensing unit through the tubing for seating in the cavity, with the upper pressure sensor in communication with the bypass port for measuring pressure in the tubing, and the lower pressure sensor in communciation with the annulus port for measuring annulus pressure, the cable means having at least one insulated electrical conductor extending through the tubing for providing from the surface the electrical power to the sensors and transmitting data from the sensors to the surface.

3. In a well having casing and a submersible centrifugal pump including a down hole motor supplied with power through a power cable, the pump being connected to a string of tubing for drawing production fluid from the annulus between the casing and tubing and pumping the fluid through the tubing to the surface, the improvement being means for monitoring at the surface the discharge and the intake pressure of the pump, comprising:

a tubular sub mounted between the pump and the tubing;

a tubular receptacle coaxially mounted inside the sub, having an axial cavity with an open upper end in axial alignment with the lower end of the tubing, and a closed lower end;

a bypass port located adjacent the upper end of the receptacle in communication with the cavity;

an annulus port adjacent the lower end of the receptacle, extending from the cavity to the exterior of the sub in communication with fluid in the annulus;

bypass passage means extending through the sub for directing fluid discharged by the pump around the receptacle and through the bypass port to the tubing;

upper and lower pressure sensors joined together in a pressure sensing unit; and cable means for lowering the pressure sensing unit through the tubing for seating in the cavity and for retrieving the pressure sensing unit from the cavity, the pressure sensing unit, when seated, having its upper pressure sensor in communication with the bypass port for monitoring discharge pressure, and its lower pressure sensor in communication with the annulus port for monitoring intake pressure, the cable means extending through the tubing and having at least one insulated electrical conductor for providing from the surface electrical power to the sensors and for transmitting signals from the sensors to the surface.

4. A method of monitoring at the surface downhole discharge and intake pressure in the vicinity of a submersible pump mounted to a string of tubing, comprising:

mounting a tubular sub between the pump and the tubing with a bypass passage extending through the sub for directing fluid discharged from the pump to the tubing;

providing the sub with a receptacle which has an annulus port leading the the exterior of the sub and a bypass port leading to the bypass passage;

lowering through the tubing on conductor cable a pressure sensing unit which has two pressure sensors, and seating the unit inside the receptacle with one pressure sensor in communication with the discharge pressure in the bypass passage through the bypass port, and the other pressure sensor in communication with the intake pressure through the annulus port; and providing power from the surface to the sensors through the conductor cable and monitoring signals from the sensors at the surface transmitted through the cable.

* * * * *